US006484419B1

(12) United States Patent
Rohde et al.

(10) Patent No.: US 6,484,419 B1
(45) Date of Patent: Nov. 26, 2002

(54) SOCKLINER COVER

(75) Inventors: Mark Rohde, Scio; Pam Greene, Portland, both of OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 09/642,900

(22) Filed: Aug. 21, 2000

(51) Int. Cl.[7] ..... A43B 13/46
(52) U.S. Cl. ..... 36/10; 36/43
(58) Field of Search ..... 36/10, 43, 164, 36/165

(56) References Cited

U.S. PATENT DOCUMENTS 985,666 A * 2/1911 Durieu
1,030,085 A * 6/1912 Hale
1,588,011 A * 6/1926 Campbell
1,811,640 A * 6/1931 Marcelle
2,070,814 A * 2/1937 Stemmons
2,559,014 A * 7/1951 Fortier
4,813,162 A 3/1989 Harris

* cited by examiner

*Primary Examiner*—Ted Kavanaugh
(74) *Attorney, Agent, or Firm*—Banner & Witcoff, Ltd.

(57) ABSTRACT

There is disclosed a removable device for covering a shoe sockliner that is not bonded to the sockliner. The device of the present invention thus permits the use of sockliners made from various materials, including foams, sponges or any other suitable recyclable materials. As disclosed, the present invention provides a flexible fabric cover which fits over the sockliner. The top surface of the cover, the surface on which ones foot is placed, has a fabric pile which may vary in thickness to provide comfort and fit for the wearer of the shoe. The bottom surface of the cover has an opening for inserting the shoe sockliner and is elastic for providing a secure fit for the cover over the shoe sockliner. Advantageously, the disclosed invention eliminates the waste associated with known top cloth manufacturing techniques, reduces the time and costs associated with manufacturing existing top cloths, and permits the use of sockliners made from various materials, including materials that are fully recyclable.

5 Claims, 6 Drawing Sheets

SOCKLINER COVER

BACKGROUND OF THE INVENTION

1. Field of Invention

The present invention relates in general to shoes. More specifically, but without restriction to the particular use which is shown and described, this invention relates to shoe sockliners and, in particular, covers for shoe sockliners.

2. Description of the Related Art

It is known that a sockliner is the part of the shoe which provides, among other things, cushioning, arch support, comfort and fit for the wearer of the shoe. As conventional, the sockliner is placed in the upper of the shoe above the shoe midsole. The sockliner if made large enough, however, may serve as the midsole of the shoe. The shoe sockliner is removable from the shoe and typically is made from non-recyclable materials such as polyurethane or EVA.

It is also known that a top cloth or cover is attached or bonded to the top surface of the sockliner, the surface on which ones foot is placed. This top cloth or cover provides the sockliner with a soft texture for added comfort and fit for the wearer's foot. Typically, the top cloth is attached to the sockliner through a gluing or a bonding process, more fully discussed below. The existing top cloth and the gluing and bonding processes for attaching the top cloth to the sockliner have numerous drawbacks which the present invention eliminates.

With respect to the gluing of the top cloth to the sockliner, the bottom surface of a sheet of top cloth is first glued to a sheet of polyurethane. The desired sockliner and accompanying top cloth are then cut from the polyurethane and top cloth sheets. The excess polyurethane and top cloth can not be used and are discarded resulting in a waste of materials. While manufacturing techniques such as nesting are used in an effort to minimize the amount of waste, there still remains waste of polyurethane and top cloth materials with this technique. Other disadvantages with this process include the manufacuturing expense of performing the multiple steps of gluing the top cloth to the polyurethane sheet and the cutting of the excess materials. Still other disadvantages include the use of polyurethane or similar materials which are non-recyclable.

Another similar gluing technique involves first molding the sockliner to the desired shape. The top cloth sheet is then glued to the top surface of the sockliner after which the edges of the top cloth that extend over the top surface are trimmed. This technique also results in waste of top cloth material and requires multiple manufacturing steps. Again, the sockliner is typically made from polyurethane, a non-recyclable material.

Bonding of the top cloth to the sockliner is another common technique for applying the top cloth to the sockliner. With this technique, a mold is used that receives the polyurethane in a liquid form. The top cloth, which has a polyurethane backing, is placed within the mold. As the liquid in the mold grows and cures, the polyurethane backing of the top cloth adheres to the growing polyurethane through a process called cross-linking. Once cured, the top cloth is bonded to the sockliner and the excess top cloth material extending beyond the edges of the sockliner top surface is trimmed. Known drawbacks with the bonding technique include the excess waste of top cloth material, the need for multiple manufacturing steps, significant equipment and mold costs, and the use of polyurethane, a non-recyclable material. Experience has also shown that with either the bonding or gluing techniques, after the shoe has been worn for a period of time, the top cloth peels away from the sockliner, diminishing the comfort and fit of the shoe. The present invention overcomes these known disadvantages associated with prior art shoe sockliners which have an attached top cloth.

SUMMARY OF THE INVENTION

Accordingly, it is an object of the present invention to overcome the disadvantages associated with gluing or bonding the top cloth to the shoe sockliner. Another object is to provide a top cloth for a shoe sockliner that does not result in waste of material. Still another object is to eliminate the multiple steps involved with gluing or bonding the top cloth to the sockliner. It is a further object of the present invention to provide a sockliner that may be made from recyclable materials. Yet another object of the invention is to provide a top cloth that may be removed from the sockliner after use and either washed or replaced with a new top cloth.

Briefly, the present invention involves a removable device for covering a shoe sockliner that is not bonded to the sockliner. The device of the present invention thus permits the use of sockliners made from various materials, including foams, sponges or any other suitable recyclable materials. One embodiment of the present invention includes a flexible fabric cover which fits over the sockliner and defines a top surface, a bottom surface, and an inner volume. The top surface of the cover, the surface on which ones foot is placed, has a fabric pile that may vary in thickness to provide comfort and fit for the wearer of the shoe. The bottom surface of the cover has an opening for inserting the shoe sockliner. The inner volume of the fabric cover receives the sockliner into the cover and envelops substantially all of the sockliner. The bottom surface is elastic for securely fitting the inventive cover over the shoe sockliner. Significantly, the present invention eliminates the waste associated with known top cloth manufacturing techniques. The present invention further reduces the manufacturing process time and associated costs with the multiple steps of attaching the top cloth to the sockliner. In addition, the present invention permits the use of sockliners made from various materials, including materials that are fully recyclable. The full range of objects, aspects and advantages of the invention are only appreciated by a full reading of this specification and a full understanding of the invention. Therefore, to complete this specification, a detailed description of the invention and the preferred embodiments follows, after a brief description of the drawings.

BRIEF DESCRIPTION OF THE DRAWINGS

The preferred embodiment of the invention will be described in relation to the accompanying drawings. In the drawings, the following figures have the following general nature.

DESCRIPTION OF THE PREFERRED EMBODIMENTS

Figure 1:
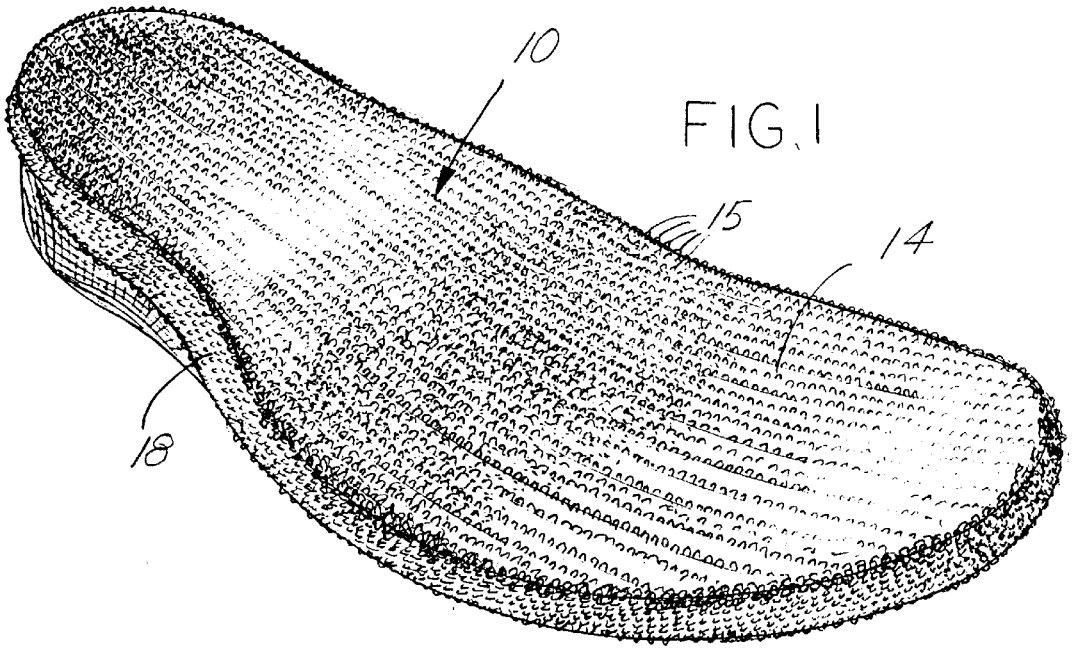
FIG. 1 is an isometric view of the present invention.
Figure 2:
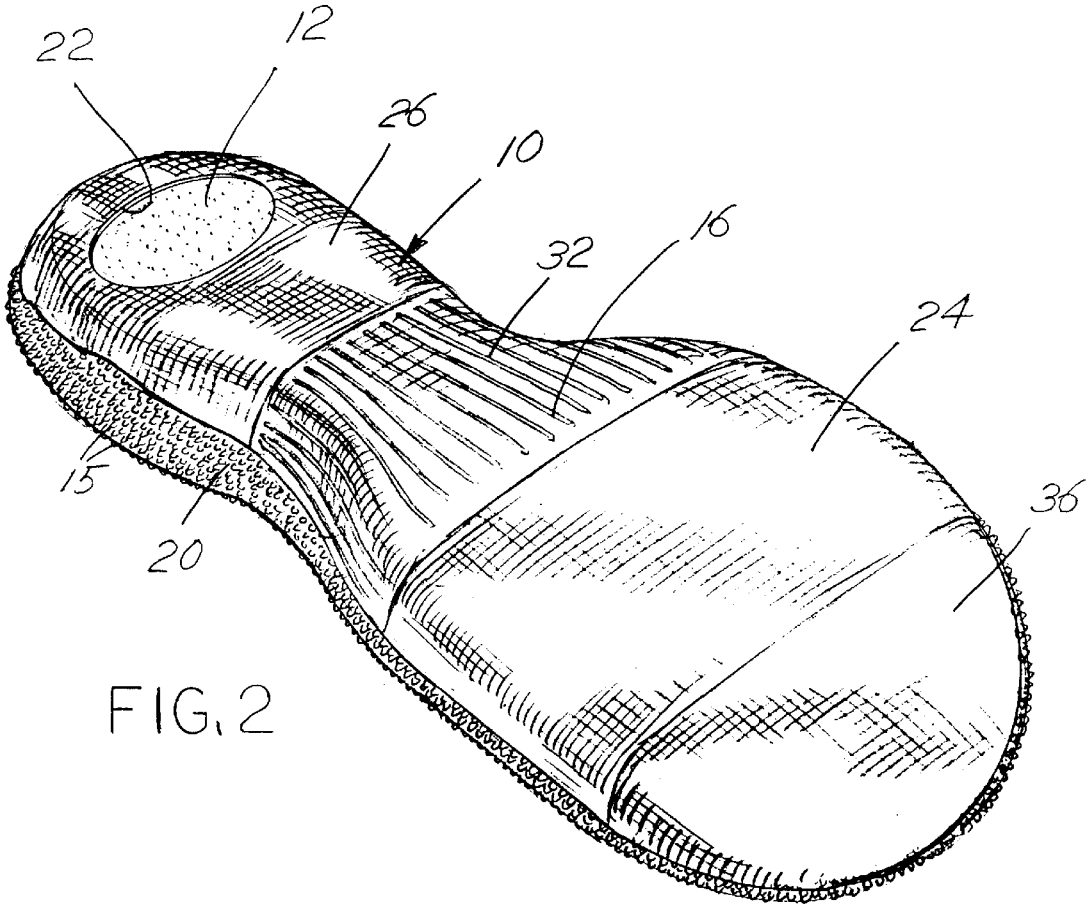
FIG. 2 is a bottom isometric view of the invention of FIG. 1.

Referring to the drawings wherein like numerals indicate like elements, there is shown in FIGS. 1–8 a device for covering a shoe sockliner according to the present invention. The device comprises a cover 10 that removably fits over the shoe sockliner 12. Unlike conventional top cloths, the cover 10 is not bonded or glued to the sockliner 12. In use, the sockliner 12 and unique cover 10 are removably inserted into a shoe.

As depicted in the figures, the cover 10 defines a top surface 14, a bottom surface 16, and opposing side surfaces 18, 20. In a preferred embodiment, the bottom surface 16 further defines an aperture or opening 22 for receiving the shoe sockliner 12, more fully described below.

Preferably, the cover 10 is made from a flexible fabric material, such as a fabric cloth. It should be understood by those of skill in the art that the material for the cover 10 is not limited to a fabric cloth but may include numerous types of materials. For instance, most materials that are knit, woven or sprayed from fibers may be used with the present invention. In addition, it is contemplated that materials which provide wicking and prevent blistering may also be used with the invention.

Figure 8:
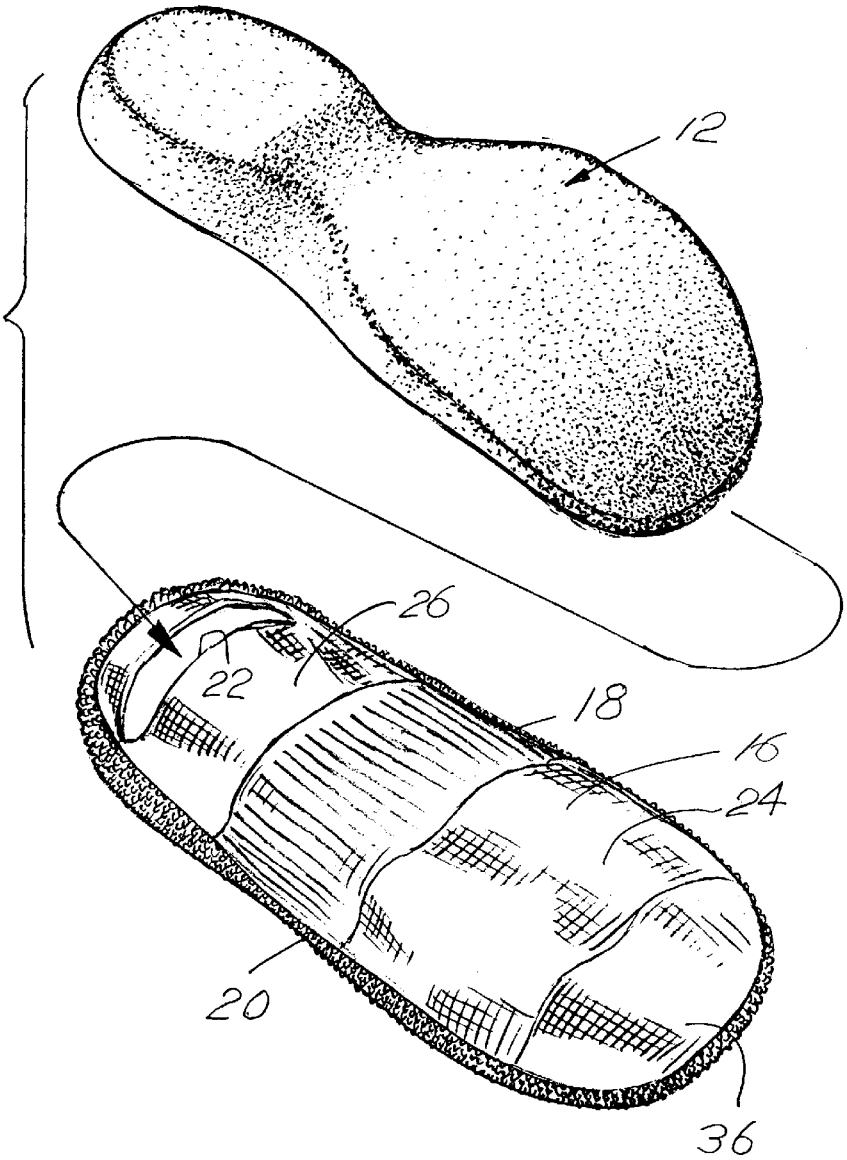
FIG. 8 is an isometric assembly view of the invention of FIG. 1.

It is preferred that the material for the cover 10 be flexible, stretchable, and deformable to match the contour of the sockliner. In addition, the cover 10 should also exhibit a certain elasticity so that the cover fits securely to the sockliner. Because of these desired properties, the cover 10, in an unstretched and unflexed state as depicted in FIG. 8, will have a length, width, girth and volume slightly less than the sockliner so that upon stretching over the sockliner, the cover will exhibit its resilient and elastic properties around the sockliner and conform to the shape of the sockliner. Upon removal, the cover 10 will return substantially to its original shape.

The top surface 14 of the cover 10—the surface on which the user places his foot—defines a fabric pile 15 for providing a soft texture to the cover, thereby providing comfort and fit for the wearer of the shoe. It should be understood that the thickness and density of the pile may vary depending on the particular user and the desired fit of the shoe. The pile may extend across the entire top surface 14 of the cover, cover only a portion of the top surface, or if desired, need not cover the top surface at all. Varying pile thicknesses and densities may also be used at various locations on the top surface.

The bottom surface 16 of the cover 10 is elastic for securely fitting the cover 10 over the sockliner. As preferred, the bottom surface consists of interwoven fabric that exhibits a certain amount of elasticity. The level and direction of elasticity will vary at different locations along the bottom surface 16 depending on the desired fit of the cover onto the sockliner. Specifically, in the forefoot region 24 and rearfoot region 26 of the bottom surface, the elastic fabric exhibits greater elasticity and flexibility in multiple directions as depicted by direction arrows 28, 30. In these regions, greater elasticity is needed for the fabric to stretch around the wider forefoot and rearfoot regions of the sockliner. In the midfoot region 32, the region between the forefoot and rearfoot regions, less elasticity is required and flexibility in only one direction is needed. At this region, it is desired that the cover fit snugly around the sockliner to inhibit longitudinal movement of the cover relative to the sockliner. Similarly, in the toe region 36, the fabric has less elasticity and unidirectional flexibility to provide a snug fit for the cover around the toe region of the sockliner. As exemplified by FIG. 2, the elastic fabric covers substantially all of the bottom surface of the sockliner. However, it is contemplated that only a portion of the bottom surface be covered by the elastic fabric or that strips of fabric may be used at various locations along the bottom surface so long as the top surface of the cover is held in a secure position relative to the sockliner. It should be further understood that the degree of elasticity and flexibility of the fabric may vary at the different regions of the bottom surface depending on the desired fit of the cover around the sockliner.

Figure 13:
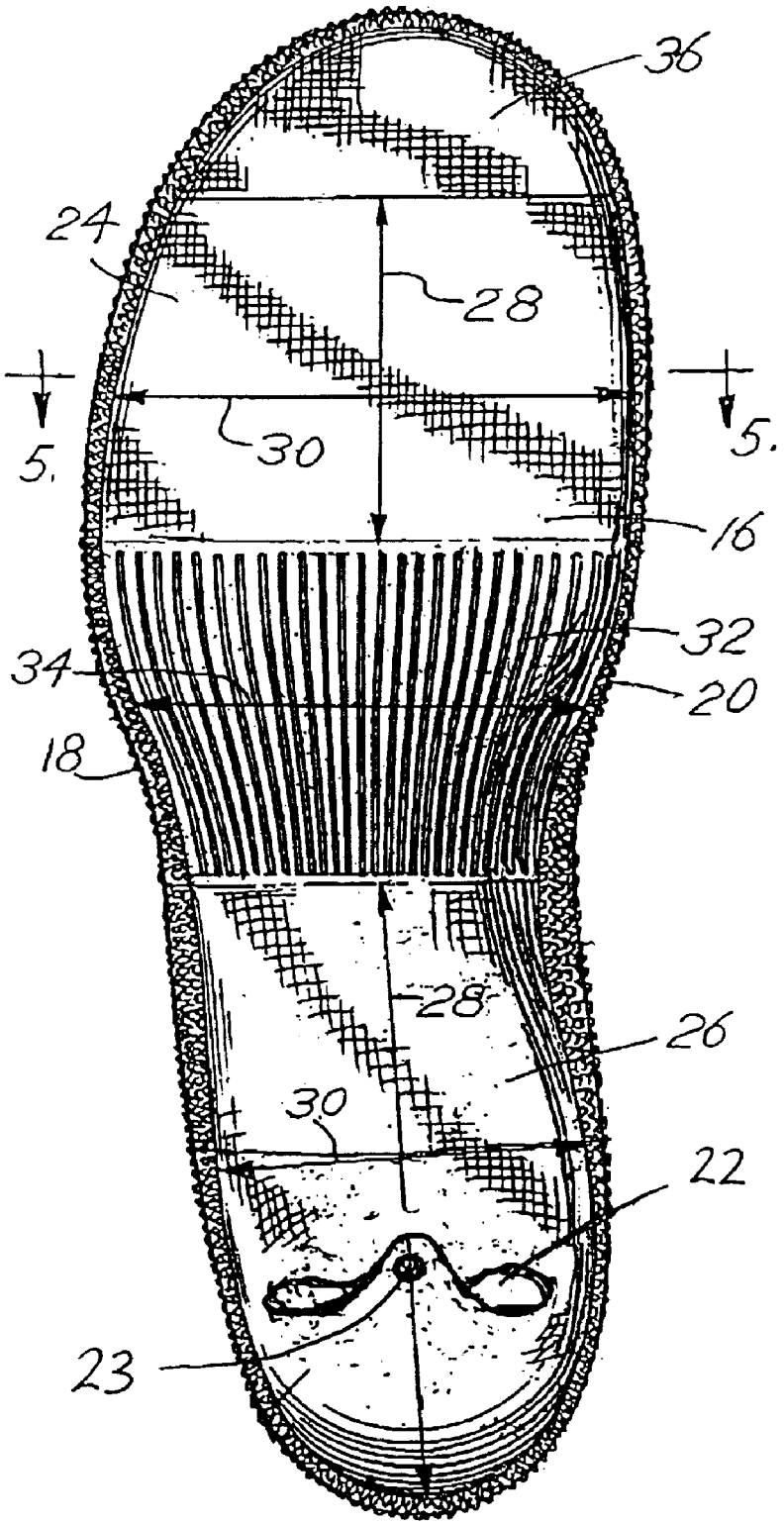
FIG. 13 is a bottom plan view of an alternative embodiment of the invention of FIG. 1.

In a preferred embodiment, located on the bottom surface 16 of the cover 10 is an opening 22 for permitting the sockliner to pass into the cover and, specifically, into the internal volume formed by the cover. The opening 22 is elastic and flexible and sized to permit the cover to fit over the sockliner. Note that the opening 22 may be located at any position along the bottom surface 16 of the cover and may be any shape or configuration which permits the cover to fit over the sockliner. Also note that while it is preferred that the opening be located on the bottom surface 16 of the cover so that the opening does not creep up or interfere with the tactile uniformity of the footbed, one of skill in the art will understand that the opening 22 may be located anywhere on the cover, i.e., on the top surface 14 or along the side surfaces 18, 20. It should be further noted that the opening 22 can have a conventional closure means 23 to further secure the opening 22, as depicted in FIG. 13. Examples of such conventional closure means 23 which may be used with the present invention include snaps, buttons, zippers, VELCRO or any other suitable means for closing the opening 22.

Figure 3:
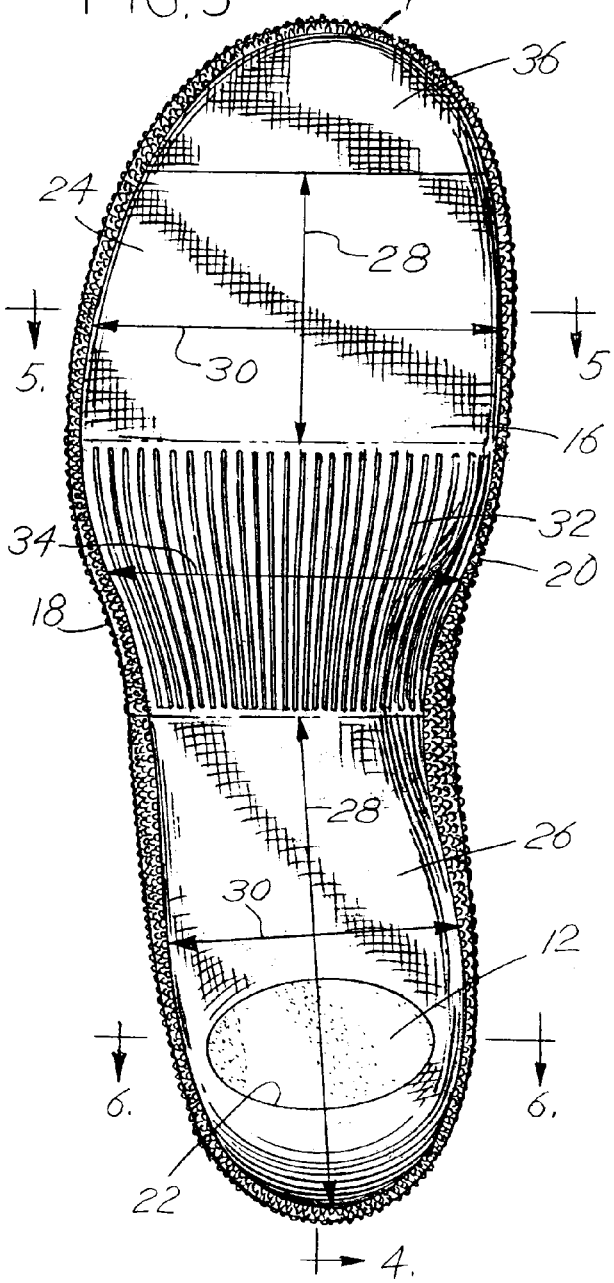
FIG. 3 is a bottom plan view of the invention of FIG. 1.
Figure 4:
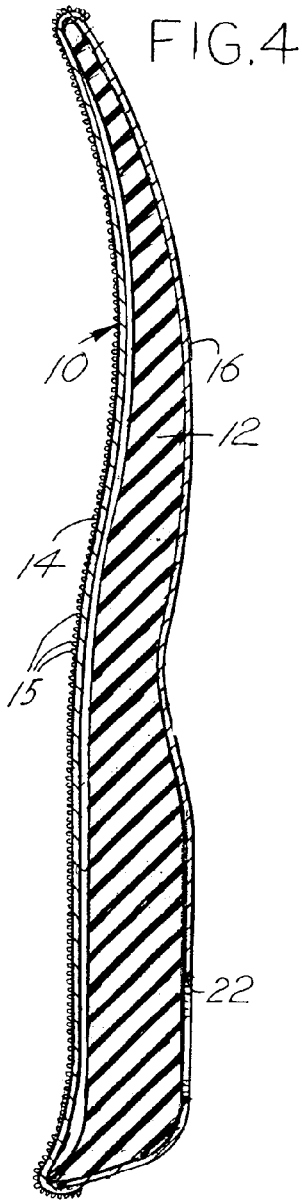
FIG. 4 is a cross-section view of FIG. 3 taken at line 4—4.
Figure 6:
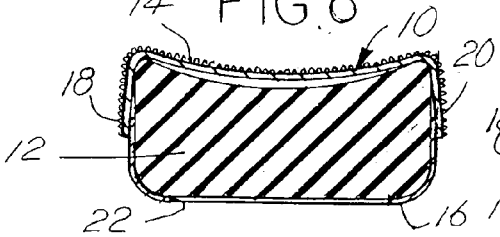
FIG. 6 is a cross-section view of FIG. 3 taken at line 6—6.
Figure 5:
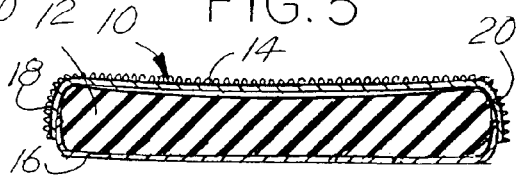
FIG. 5 is a cross-section view of FIG. 3 taken at line 5—5.
Figure 7:
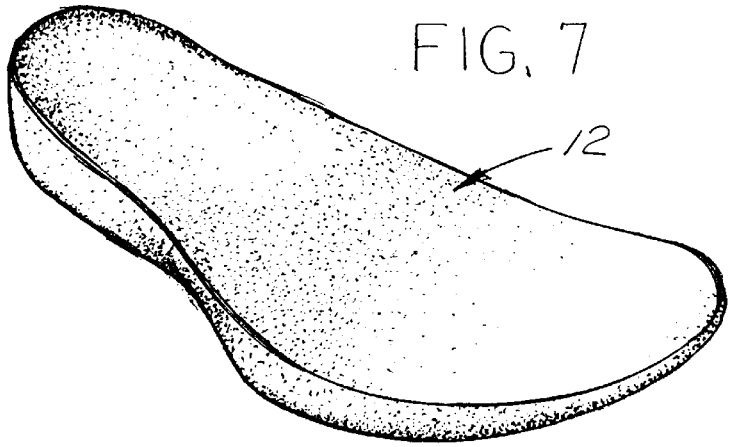
FIG. 7 is an isometric view of a shoe sockliner.

Referring to FIG. 3, the desired elasticity and flexibility along the opposing side surfaces 18, 20, are generally the same as the bottom surface at the various regions. That is, the desired elasticity and directional flexibility along the side surfaces at the forefoot, rearfoot, midfoot, and toe regions are generally the same as the respective regions on the bottom surface 16. As depicted, the fabric pile joins with the elastic fabric along the side surfaces. With the preferred embodiment, there are no seams between the fabric pile and elastic fabric. However, it should be understood to those of skill in the art that depending on the types of materials used on the top and bottom surfaces, seams may be necessary as various methods of attaching the materials may be used.

Significant advantages with the inventive cover 10 exist over the known top cloths glued or bonded to the non-recyclable sockliners. Because the cover 10 is removable and made from a fabric, it is easily washable to remove odor causing agents. The fabric may be further treated with an antifungal agent to provide antifungal control. The cover may also be made from environmentally safe recyclable materials. Also, it is possible to provide various types, colors or patterns of covers depending on the wearer's preference. Fashionable screen printing, embroidering, or other decorative designs may be placed on the cover to provide a distinctive look or to identify the manufacturer of the shoe. Additional advantages exist with respect to the fabric piles. As stated above, varying pile thicknesses and densities may be used to provide for proper anatomical fit for the wearer. The pile thickness can also vary to further provide orthopedic support and additional cushioning at specific zones where the foot strikes the ground.

Figure 12:
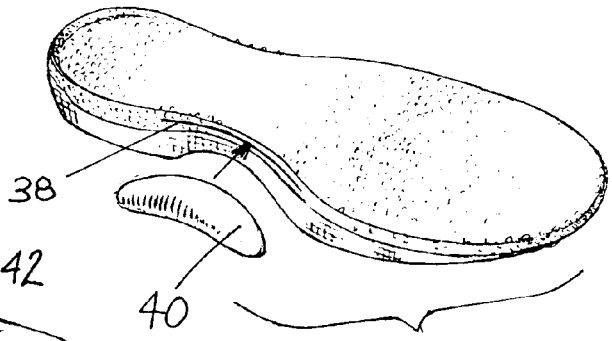
FIG. 12 is an isometric assembly view of an arch support with the invention of FIG. 1.

Referring to FIG. 12, an alternative embodiment of the cover includes the use of a pocket, as depicted by slit 38, which can be knitted or woven into the cover so that a removable arch support 40 can be placed into the pocket. It should be understood that heel paddings, orthopedic devices, or similar devices can be used with the present invention and may be placed in one or more pockets which may be located at any location on the cover.

Figure 9:
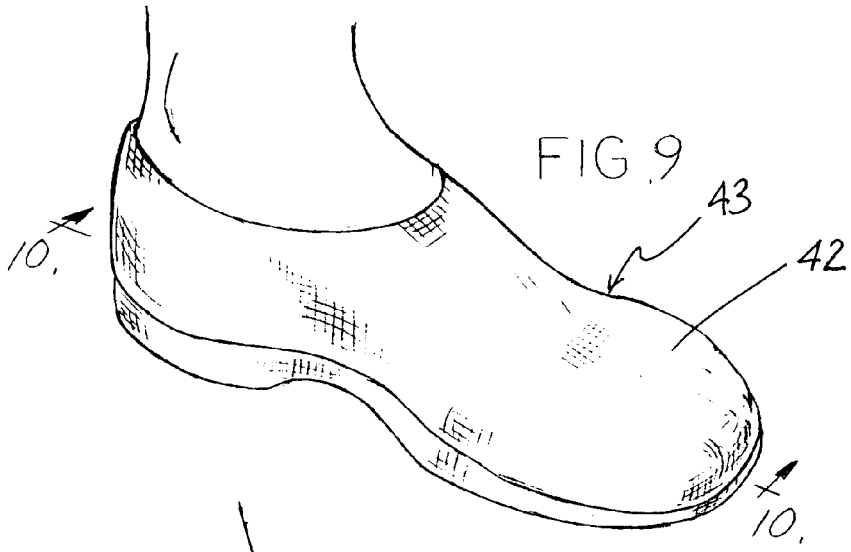
FIG. 9 is an isometric view of an alternative embodiment of the invention of FIG. 1.
Figure 10:
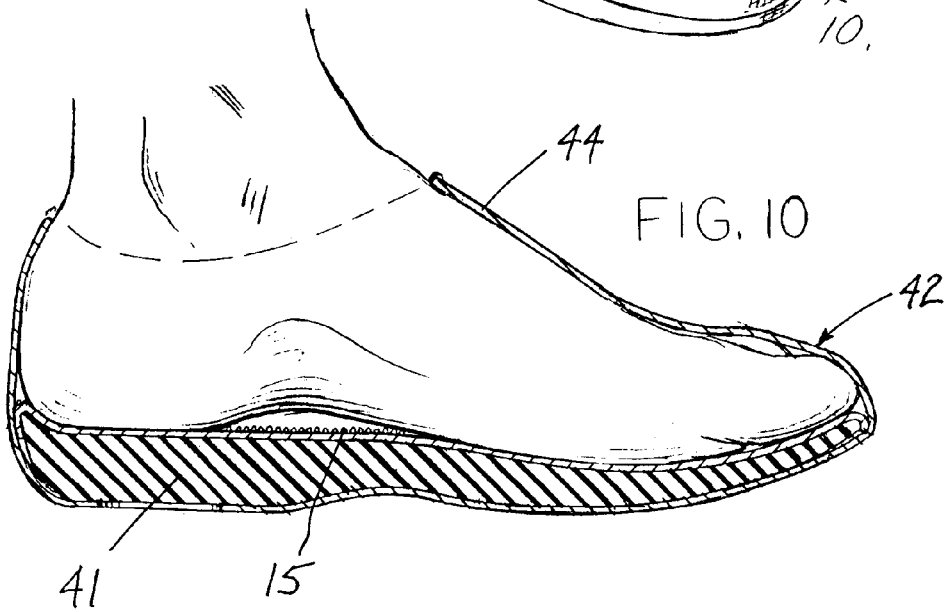
FIG. 10 is a cross-section view of FIG. 9 taken at line 10—10.
Figure 11:
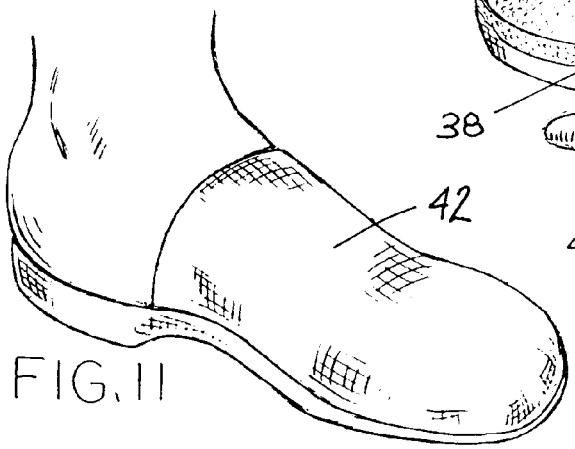
FIG. 11 is an isometric view of an alternative embodiment of the invention of FIG. 1.

Referring to FIGS. 9–11, another alternative embodiment of the present invention is depicted. With this embodiment, the sockliner 41 and sockliner cover 42 form a shoe 43. This is accomplished by modifying the sockliner 41 so that the sockliner functions as a shoe midsole and by attaching to or making integral with the sockliner cover 42 a shoe upper 44. As depicted, the shoe upper 44 is formed integral with the sockliner cover and may be made from the same flexible fabric material as the sockliner cover. Note that variations of the shoe upper exist, as exemplified in FIG. 11, which shows the shoe upper 44 forming over the top of the foot only and not around the heel of the foot. It will be understood by those of skill in the art that other means of holding the sockliner onto the foot are possible with the present invention, for instance, through the use of straps, elastic bands, or other suitable means for holding the sockliner onto the foot.

Figure 14:
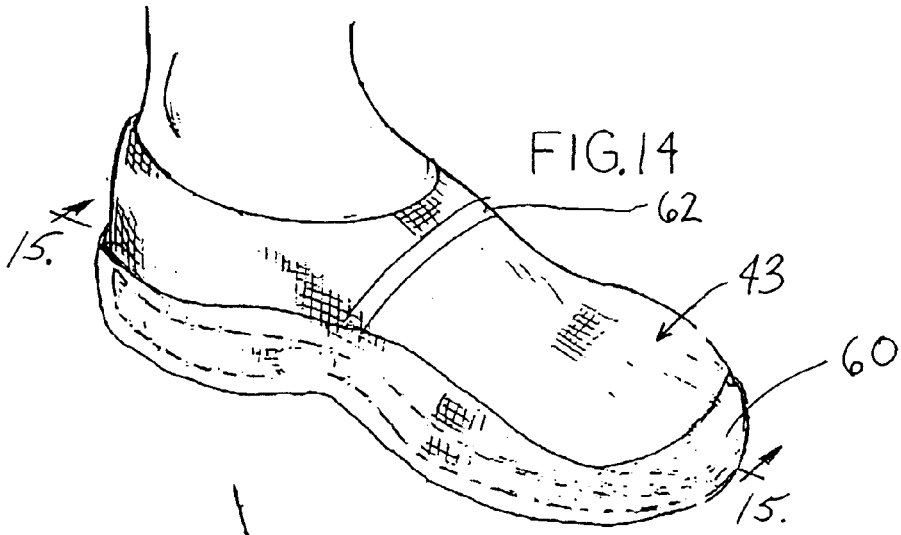
FIG. 14 is an isometric view of an alternative embodiment of the invention of FIG. 1.
Figure 15:
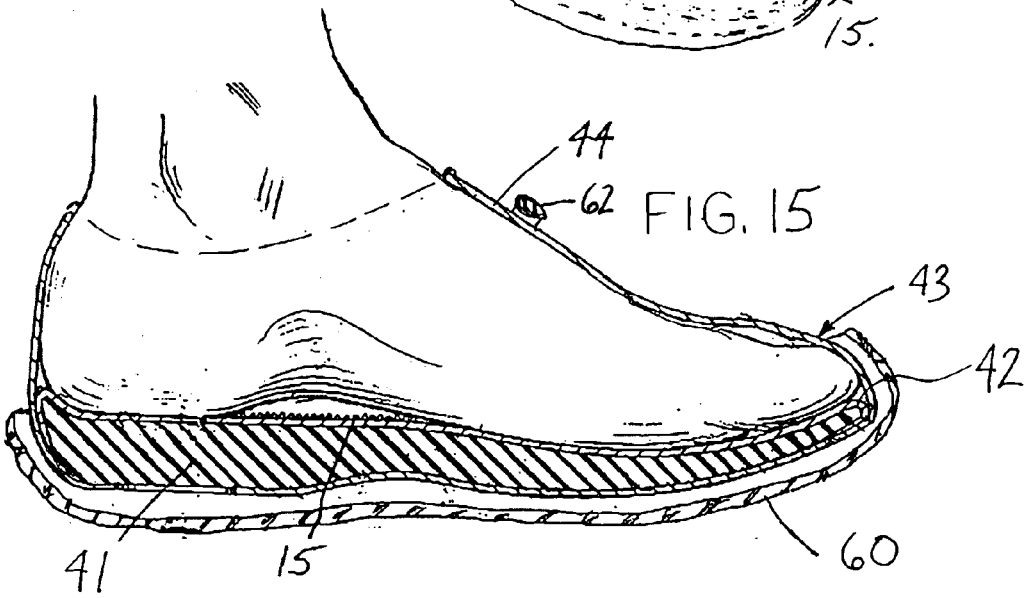
FIG. 15 is a cross-section view of FIG. 14 taken at line 15—15.
Figure 16:
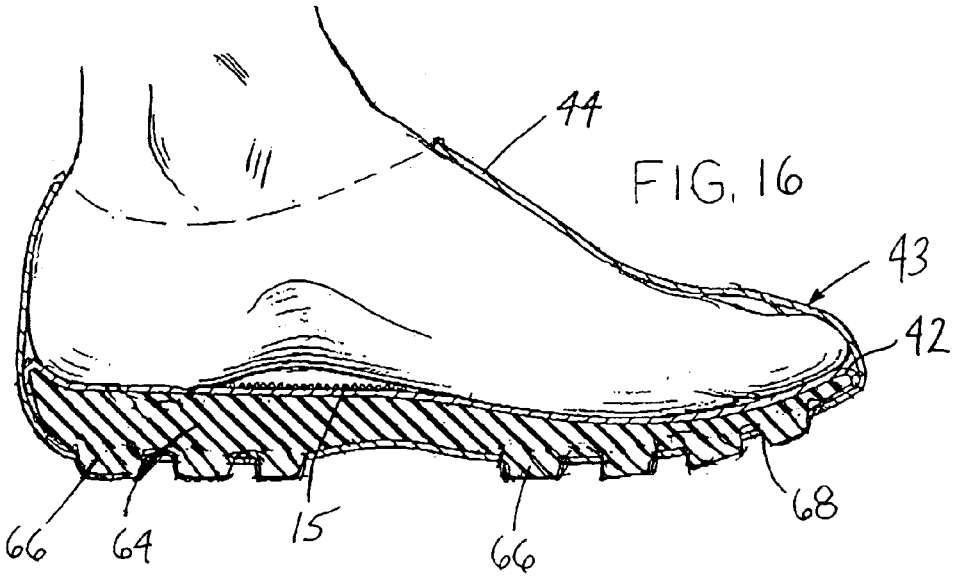
FIG. 16 is a cross-section view of an alternative embodiment of the invention of FIG. 1.

It will be further understood by those of skill in the art that an outsole may be formed or placed on the shoe 43. Examples of outsoles include a dip or spray coating of a high durable material which is applied to the bottom surface of the sockliner cover 42 to create a durable traction surface. Alternatively, as depicted in FIGS. 14–15, a lightweight durable frame 60 may be slipped over the shoe 43 and secured around the shoe through the use of a strap 62, a plurality of straps, laces, or any other suitable means for securing the frame 60 to the shoe 43. The durable frame 60 not only serves as a shoe outsole it also provides protection from the elements. Still another embodiment is depicted in FIG. 16 which shows a sockliner 64 that includes traction elements 66 that protrude through the sockliner cover and serve as the outsole. The traction elements 66, which are made of a high durable material, extend downward from the sockliner 64, through openings 68 in the sockliner cover, and function as the traction surface for the shoe. A person of skill in the art will understand that further embodiments of the outsole are possible and still be considered within the scope of the present invention.

With the use of the removable cover of the present invention, a single sockliner cover can be used to cover multiple sizes of sockliners. Moreover, there is no longer the need to use sockliners that must bond or attach to the prior art top cloths. In contrast to conventional sockliners made from polyurethane, the present invention permits the use of sockliners made from a variety of new materials, including foams, sponges, corks, synthetic polymers, organic materials, polyolefin, or any other suitable materials that are not cross-linked and thus are recyclable. The advantages associated with the ability to recycle old shoe sockliners are significant and quite obvious.

The preferred embodiments of the invention are now described as to enable a person of ordinary skill in the art to make and use the same. Variations of the preferred embodiment are possible without being outside the scope of the present invention. For example, it is contemplated that multiple openings may be used along the top, bottom or side surfaces of the sockliner cover to provide a window for the airbags that may be used in the sockliner, or any logos or other manufacturer indicia. Therefore, to particularly point out and distinctly claim the subject matter regarded as the invention, the following claims conclude the specification.

What is claimed is:

1. A shoe assembly for providing fit and comfort for a wearer of a shoe, the assembly comprising:

a shoe sockliner that is removably inserted into a shoe;

a flexible seamless fabric cover removably fitted onto the shoe sockliner, the cover defining a top surface, a bottom surface, and opposing side surfaces, the top surface having a fabric pile, the bottom surface having an opening for inserting the shoe sockliner into the cover, the bottom surface being elastic to provide a secure fit for the cover onto the shoe sockliner whereby there are no seams between the fabric pile of the top surface and the elastic bottom surface.

2. The shoe assembly of claim 1 wherein the shoe sockliner is made from recyclable materials.

3. The shoe assembly of claim 1 wherein the bottom surface defines a toe region, a forefoot region, a midfoot region, and a rearfoot region.

4. The shoe assembly of claim 3 wherein the midfoot region is elastic substantially in one direction.

5. The shoe assembly of claim 3 wherein the forefoot and rearfoot regions are elastic in multiple directions.

* * * * *